US009412531B2

(12) United States Patent
Kobayashi et al.

(10) Patent No.: US 9,412,531 B2
(45) Date of Patent: Aug. 9, 2016

(54) FOUR-DIRECTION SWITCH DEVICE

(71) Applicants: TOYO DENSO CO., LTD., Tokyo (JP); HONDA MOTOR CO., LTD., Tokyo (JP)

(72) Inventors: Masahito Kobayashi, Tsurugashima (JP); Kazuteru Abe, Tsurugashima (JP); Masahiko Shimada, Wako (JP); Hiroyuki Tanaka, Wako (JP)

(73) Assignees: TOYO DENSO CO., LTD., Tokyo (JP); HONDA MOTOR CO., LTD., Tokyo (JP)

( * ) Notice: Subject to any disclaimer, the term of this patent is extended or adjusted under 35 U.S.C. 154(b) by 7 days.

(21) Appl. No.: 14/327,741

(22) Filed: Jul. 10, 2014

(65) Prior Publication Data

US 2015/0014139 A1 Jan. 15, 2015

(30) Foreign Application Priority Data

Jul. 12, 2013 (JP) ..... 2013-146503

(51) Int. Cl.

| | |
|---|---|
| ***H01H 13/70*** | (2006.01) |
| ***H01H 25/00*** | (2006.01) |
| ***H01H 25/04*** | (2006.01) |
| ***H01H 13/06*** | (2006.01) |
| ***H01H 13/72*** | (2006.01) |
| ***H01H 13/85*** | (2006.01) |

(52) U.S. Cl.

CPC ..... *H01H 13/063* (2013.01); *H01H 13/72* (2013.01); *H01H 13/85* (2013.01); *H01H 2217/018* (2013.01); *H01H 2217/024* (2013.01); *H01H 2221/06* (2013.01)

(58) Field of Classification Search

CPC ..... H01H 13/70; H01H 25/00; H01H 25/04; H01H 25/041; H01H 1/00; H01H 1/12; H01H 1/24; H01H 1/22; H01H 3/00; H01H 3/02; H01H 3/04; H01H 3/12; H01H 5/18; H01H 13/00; H01H 13/02; H01H 13/20; H01H 21/00; H01H 21/02; H01H 21/04; H01H 21/18; H01H 21/22; H01H 21/24; H01H 21/54; H01H 21/56; H01H 21/60; H01H 3/003; H01H 3/025; H01H 3/14; H01H 3/143; H01H 3/16; H01H 3/30; H01H 2221/00; H01H 2221/012; H01H 2221/016; H01H 2221/018; H01H 2221/078; H01H 2221/088; H01H 2231/008; G06F 3/0338; G06F 3/044

USPC ..... 200/5 R

See application file for complete search history.

(56) References Cited

U.S. PATENT DOCUMENTS

| | | | | |
|---|---|---|---|---|
| 2001/0023816 | A1* | 9/2001 | Kuriyama | H01H 25/041 200/6 A |
| 2006/0113170 | A1* | 6/2006 | Rochon | H01H 25/06 200/5 R |

FOREIGN PATENT DOCUMENTS

| | | |
|---|---|---|
| JP | 56-114230 | 9/1981 |
| JP | 60-69441 U | 5/1985 |
| JP | H01139331 U | 9/1989 |
| JP | 3-110733 | 11/1991 |
| JP | 07-335083 | 12/1995 |

OTHER PUBLICATIONS

Chinese Office Action dated Nov. 26, 2015, 6 pages.

* cited by examiner

*Primary Examiner* — Renee Luebke
*Assistant Examiner* — Anthony R. Jimenez
(74) *Attorney, Agent, or Firm* — Rankin, Hill & Clark LLP

(57) ABSTRACT

In a four-direction switch device, an outer peripheral surface of a disc-shaped switch knob is provided with first to fourth pivot projections arranged in phase with first to fourth switch operation parts and first to fourth movable stoppers arranged with a phase shift by 45° from the projections, respectively, and a switch case is provided with first to fourth fixed stoppers facing lower surfaces of the movable stoppers, respectively. If the knob is pushed at a switch dead part, the knob swings about a straight line connecting a pair of the pivot projections located on an opposite side of the switch dead part, but the movable stopper and the fixed stopper both located below the pushed switch dead part come into contact with each other, thereby avoiding actuation of any switch.

2 Claims, 7 Drawing Sheets

FOUR-DIRECTION SWITCH DEVICE

BACKGROUND OF THE INVENTION

1. Field of the Invention

The present invention relates to an improvement of a four-direction switch device comprising: a switch case having an opening portion in an upper wall thereof; and a plate-shaped switch knob arranged in the opening portion, the switch knob being set to have first to fourth switch operation parts arranged at angular intervals of 90° about a center axis of the switch knob; and first to fourth switches provided in the switch case and to be actuated respectively in response to push operations on the first to fourth switch operation parts.

2. Description of the Related Art

Such a four-direction switch device is known as disclosed in, for example, Japanese Utility Model Application Laid-open No. 1-139331.

SUMMARY OF THE INVENTION

The four-direction switch device disclosed in Japanese Utility Model Application Laid-open No. 1-139331 described above includes: a switch knob formed in a square plate shape with center portions of four sides of the switch knob set as switch operation parts and with four corners of the switch knob set as switch dead parts; and a switch case provided with stoppers each configured to, when the corresponding one of the switch dead parts is pushed, prevent the switch knob from swinging before the switch is actuated. In the switch device with this structure, when one of the switch dead parts is pushed, a swing pivot of the switch knob is a point of the corresponding one corner of the switch knob. For this reason, even when the switch knob is stopped from swinging, the switch knob is likely to become unsteady about an axis connecting two points which are one corner and one stopper, and such unsteadiness may actuate a switch erroneously.

The present invention has been made in view of the above problematic circumstances, and has an object to provide a four-direction switch device which is capable of, when a switch dead part of a switch knob is pushed, preventing unsteadiness of the switch knob if the switch knob is stopped from swinging, and thereby avoiding an unnecessary actuation of a switch.

In order to achieve the object, according to a first feature of the present invention, there is provided a four-direction switch device comprising: a switch case having an opening portion in an upper wall thereof; and a plate-shaped switch knob arranged in the opening portion, the switch knob being set to have first to fourth switch operation parts arranged at angular intervals of 90° about a center axis of the switch knob; and first to fourth switches provided in the switch case and to be actuated respectively in response to push operations on the first to fourth switch operation parts, wherein the switch knob is formed in a disc shape, and is provided with first to fourth pivot projections and first to fourth movable stoppers on an outer peripheral surface of the switch knob, the first to fourth pivot projections projecting radially outward and arranged in phase with the first to fourth switch operation parts, the first to fourth movable stoppers arranged with a phase shift by 45° from the first to fourth pivot projections, respectively, the switch case is provided with first to fourth fixed stoppers opposed to lower surfaces of the first to fourth movable stoppers, respectively, and when the switch knob is pushed at a switch dead part located in an intermediate position between the adjacent switch operation parts, the switch knob swings about a straight line connecting a pair of the pivot projections located on an opposite side of the switch dead part with the center axis of the switch knob interposed between the pair of the pivot projections and the switch dead part, but the movable stopper, as one of said first to fourth movable stoppers, and the fixed stopper, as one of said first to fourth fixed stoppers, both located below the pushed switch dead part come into contact with each other so as to stop the switch knob from swinging, thereby avoiding actuations of the switches.

According to the first feature of the present invention, if a user pushes one of switch dead parts by mistake, the switch knob swings slightly by using as a pivot axis a straight line connecting adjacent two of the pivot projections which are located on the opposite side of the one switch dead part with the center axis of the switch knob interposed between the one switch dead part and the two pivot projections, but immediately after that, one of the movable stoppers corresponding to the one switch dead part comes into contact with the corresponding fixed stopper and thereby stops the switch knob from swinging any more. In this way, the actuations of the switches are avoided. Moreover, at this time, the switch knob is supported by three points of the two pivot projections and the one movable stopper, which can prevent the switch knob from tottering and therefore can avoid the actuation of any switch due to the tottering motion.

Note that the switch knob corresponds to an outer switch knob 16 in an embodiment of the present invention described later.

According to a second feature of the present invention, in addition to the first feature, each of the pivot projections includes a flat top surface orthogonal to a diameter line of the switch knob and a pair of inclined surfaces inclined to descend from opposite ends of the top surface to the outer peripheral surface of the switch knob, and the adjacent inclined surfaces of each pair of the adjacent pivot projections are positioned on the common straight line.

According to the second feature of the present invention, when one switch operation part is pushed to actuate one of the switches, an upper edge portion of the top surface of the pivot projection serving as the swing pivot of the switch knob forms a straight line orthogonal to a radius line of the switch knob. Thus, the pivot is formed as a pivot axis. This can prevent the switch knob from tottering and can also improve durability of the pivot projections.

In addition, even if the switch knob totters, any one of the two movable stoppers adjacent to the one switch operation part comes into contact with the corresponding fixed stopper so as to prevent the switch knob from tottering excessively. Thus, an unnecessary actuation of any switch other than the one switch to be actuated can be avoided.

Furthermore, the adjacent inclined surfaces of the adjacent pivot projections are arranged on the common straight line. Accordingly, in swing of the switch knob in response to a push of one switch dead part, the pivots of the adjacent pivot projections are in a line contact state, and therefore the durability of the pivot projections can be enhanced.

The above and other objects, characteristics and advantages of the present invention will be clear from detailed descriptions of the preferred embodiment which will be provided below while referring to the attached drawings.

DESCRIPTION OF THE PREFERRED EMBODIMENT

Figure 1:
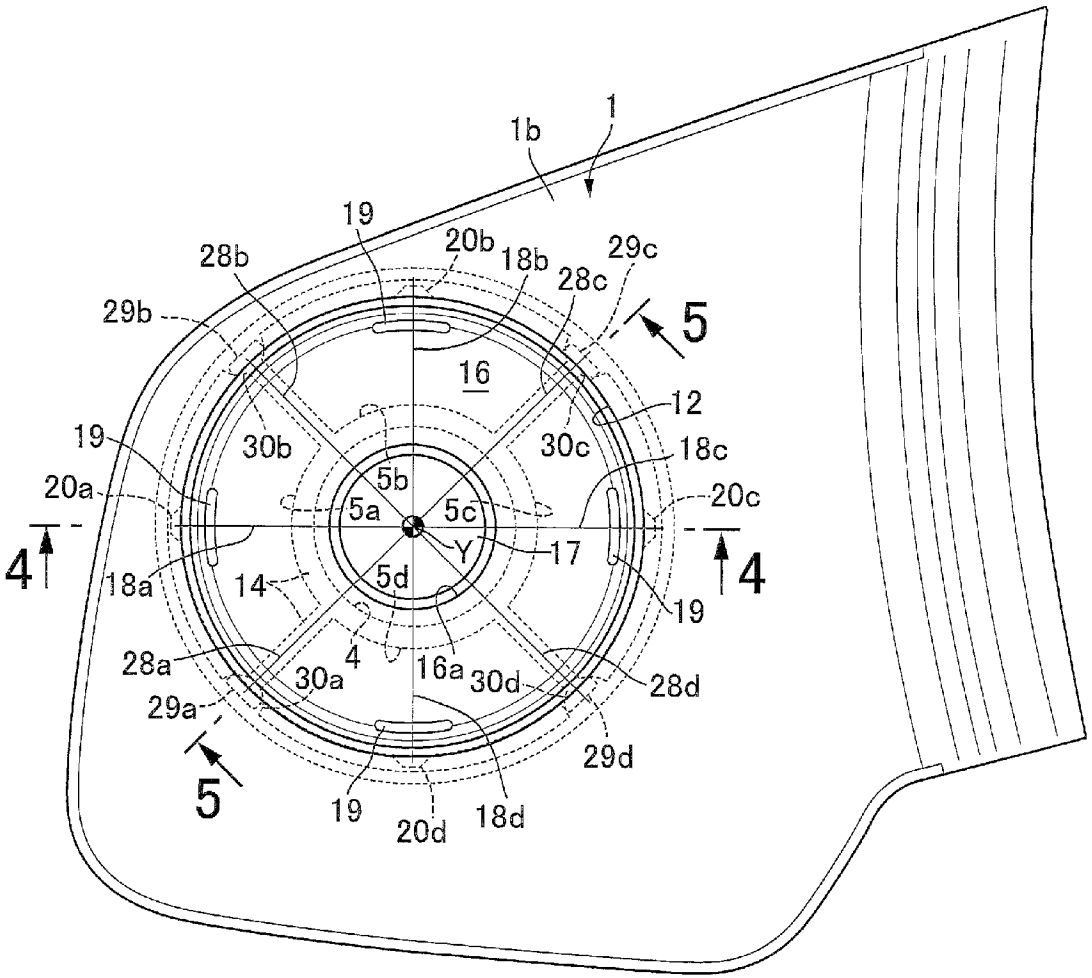
FIG. 1 is a plan view of a four-direction switch device according to the present invention.
Figure 2:
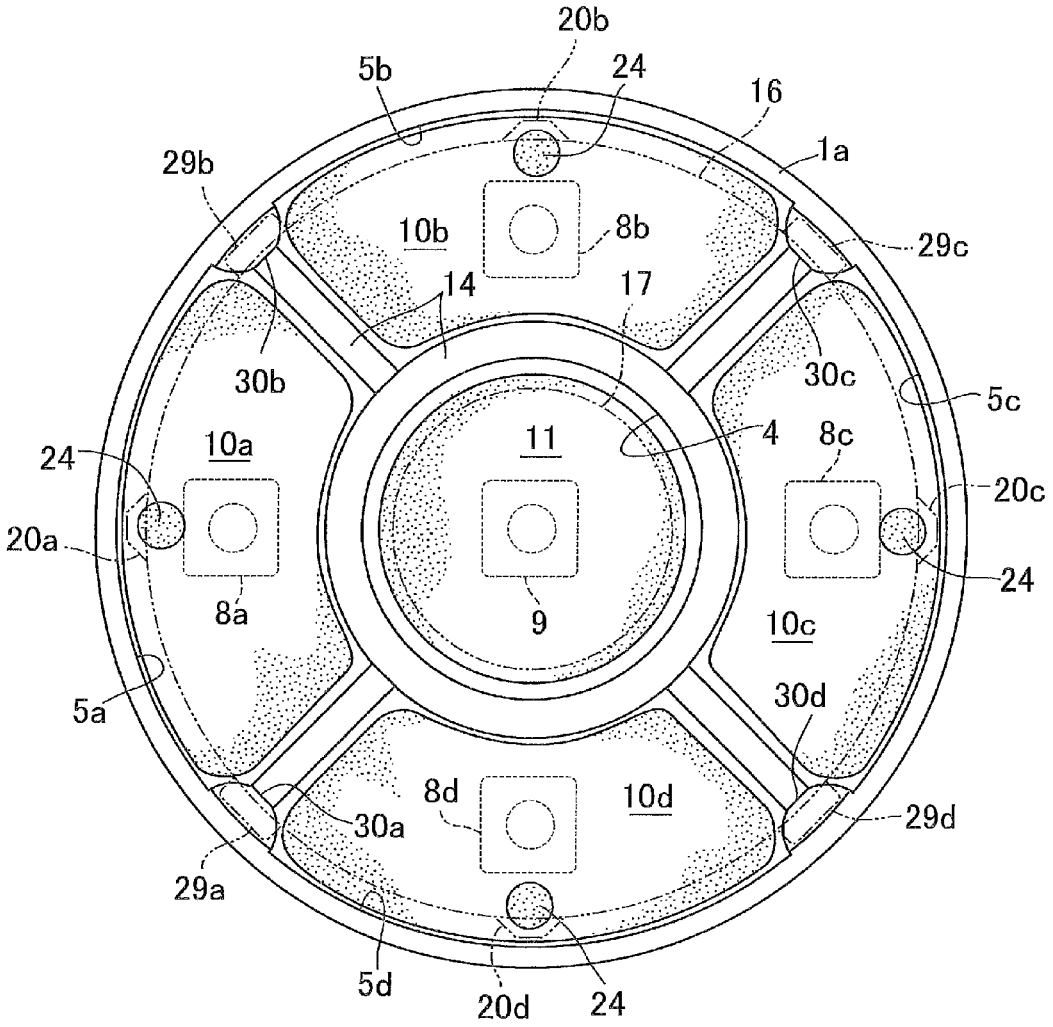
FIG. 2 is a plan view of the four-direction switch device with an upper case and a water-proof diaphragm removed.
Figure 3:
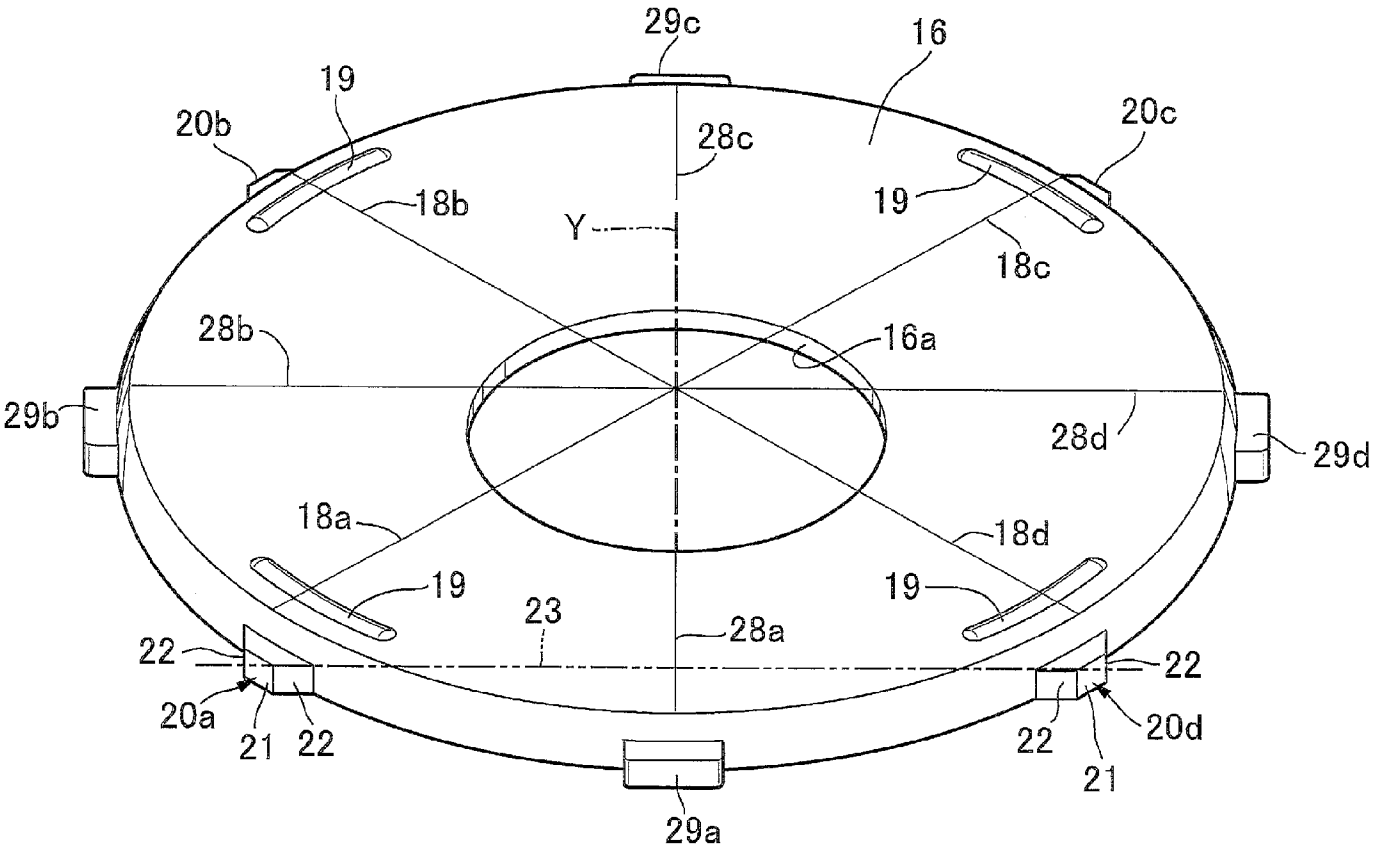
FIG. 3 is a perspective view of a switch knob of the four-direction switch device.
Figure 4:
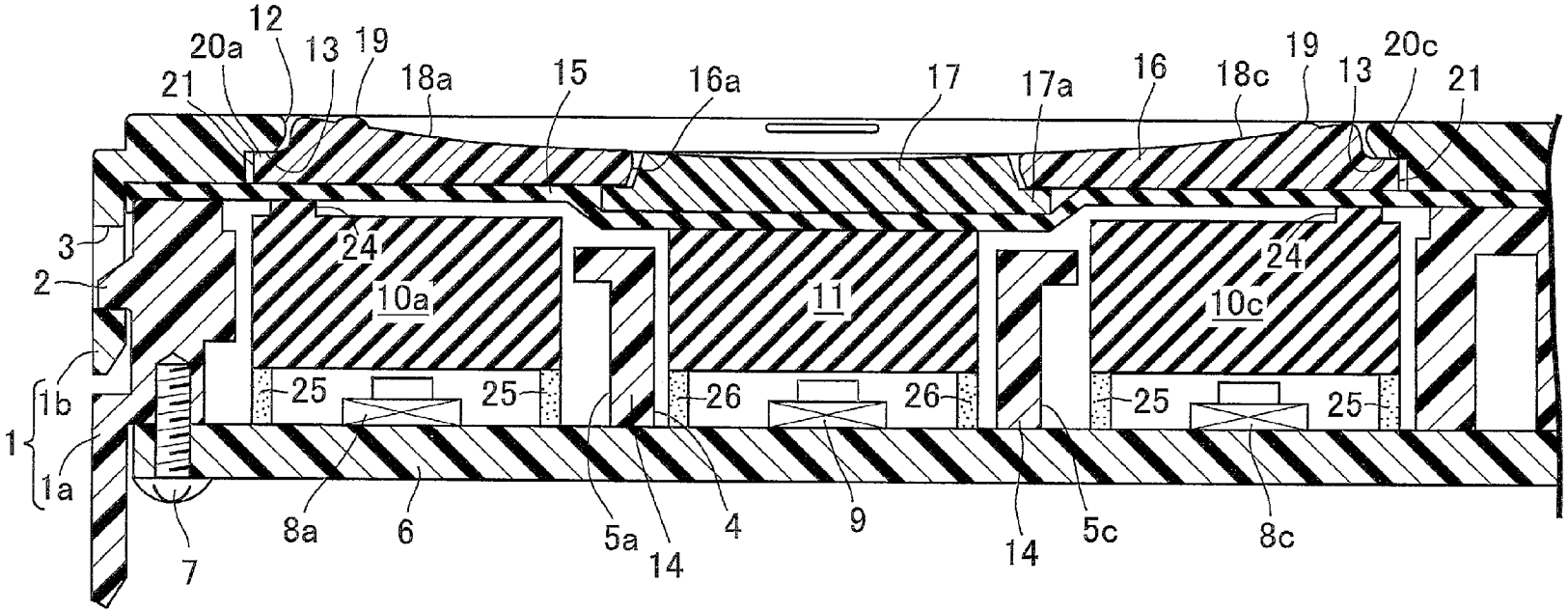
FIG. 4 is a sectional view taken along a line 4-4 in FIG. 1.

Hereinafter, an embodiment of the present invention is described based on the accompanying drawings.

Firstly, as illustrated in FIGS. 1 to 4, a switch case 1 of a four-direction switch device includes a lower case 1*a* and an upper case 1*b* fitted to an outer periphery of the lower case 1*a*. Multiple locking claws 2 are provided to protrude on the outer peripheral surface of the lower case 1*a*, and catch holes 3 are provided in a peripheral wall of the upper case 1*b*. The lower case 1*a* and the upper case 1*b* are joined together with the locking claws 2 and the catch holes 3 engaged with each other.

An inside of the lower case 1*a* is partitioned, by a partition wall 14 formed integrally with the lower case 1*a*, into a center switch chamber 4 and first to fourth switch chambers 5*a* to 5*d* annularly surrounding the center switch chamber 4. A control circuit substrate 6 is fixed to a lower portion of the lower case 1*a* with screws 7. First to fourth switches 8*a* to 8*d* respectively arranged in the first to fourth switch chambers 5*a* to 5*d* and a center switch 9 arranged in the center switch chamber 4 are mounted on the control circuit substrate 6. The first to fourth switches 8*a* to 8*d* and the center switch 9 are formed by using, for example, tactile switches.

In addition, first to fourth transmission members 10*a* to 10*d* facing actuators of the first to fourth switches 8*a* to 8*d* are provided in the first to fourth switch chambers 5*a* to 5*d*, and a center transmission member 11 facing an actuator of the center switch 9 is provided in the center switch chamber 4.

An upper wall of the upper case 1*b* is provided with a circular opening portion 12 and an annular downward-facing stepped portion 13 continuous from an inner peripheral surface of the opening portion 12. Moreover, an outer peripheral edge portion of a water-proof diaphragm 15 covering the center switch chamber 4 and the first to fourth switch chambers 5*a* to 5*d* is fixedly held between the upper wall of the upper case 1*b* and an upper end surface of the lower case 1*a*. A disc-shaped outer switch knob 16 arranged in the opening portion 12 and a center switch knob 17 arranged in a center hole 16*a* of the outer switch knob 16 are attached to an upper surface of the water-proof diaphragm 15 by adhesion.

The outer switch knob 16 is set to have first to fourth switch operation parts 18*a* to 18*d* which are arranged, corresponding to the first to fourth switch chambers 5*a* to 5*d*, respectively, at angular intervals of 90° about a center axis Y of the outer switch knob 16. Projections 19 are formed to project on an upper surface of the outer switch knob 16. When touched by a user, each of the projections 19 makes the user recognize the corresponding one of the first to fourth switch operation parts 18*a* to 18*d*. Additionally, first to fourth pivot projections 20*a* to 20*d* projecting radially outward and arranged in phase with the first to fourth switch operation parts 18*a* to 18*d* are provided integrally on an outer peripheral surface of the outer switch knob 16. These first to fourth pivot projections 20*a* to 20*d* are supported by the downward-facing stepped portion 13.

Further, the center switch knob 17 includes a flange 17*a* at an outer periphery of a lower portion of the center switch knob 17, and the flange 17*a* is supported by a lower surface of an inner peripheral end portion of the outer switch knob 16.

Each of the pivot projections 20*a* to 20*d* includes a flat top surface 21 orthogonal to a diameter line of the outer switch knob 16, and a pair of inclined surfaces 22 inclined to descend from opposite ends of the top surface 21 to the outer peripheral surface of the outer switch knob 16. Then, the adjacent inclined surfaces 22 of each pair of the adjacent pivot projections 20*a*, 20*b*; 20*b*, 20*c*; 20*c*, 20*d*; 20*d*, 20*a* are positioned on a common straight line 23.

Pressure receiving projections 24 are formed respectively on upper surfaces of the first to fourth transmission members 10*a* to 10*d*. The pressure receiving projections 24 are in contact, via the water-proof diaphragm 15, with a lower surface of the outer switch knob 16 at portions corresponding to the first to fourth switch operation parts 18*a* to 18*d*, respectively.

The first to fourth transmission members 10*a* to 10*d* include respective elastic legs 25 which are integrally formed, respectively, and placed in contact with an upper surface of the control circuit substrate 6 to bias the first to fourth transmission members 10*a* to 10*d* upward, respectively. The upward biasing force applied to the transmission members 10*a* to 10*d* by the respective elastic legs 25 acts on the outer switch knob 16 via the water-proof diaphragm 15 to press the first to fourth pivot projections 20*a* to 20*d* against a lower surface of the downward-facing stepped portion 13, and thereby allows the first to fourth pivot projections 20*a* to 20*d* to be supported by the lower surface of the downward-facing stepped portion 13, as described above.

Moreover, the center transmission member 11 also includes an elastic leg 26 integrally formed and placed in contact with the upper surface of the control circuit substrate 6 to bias the center transmission member 11 upward. The upward biasing force applied to the center transmission member 11 by the elastic leg 26 acts on the center switch knob 17 via the water-proof diaphragm 15 to press the flange 17*a* against the lower surface of the outer switch knob 16, and thereby allows the flange 17*a* to be supported by the lower surface of the outer switch knob 16, as described above.

Figure 5:
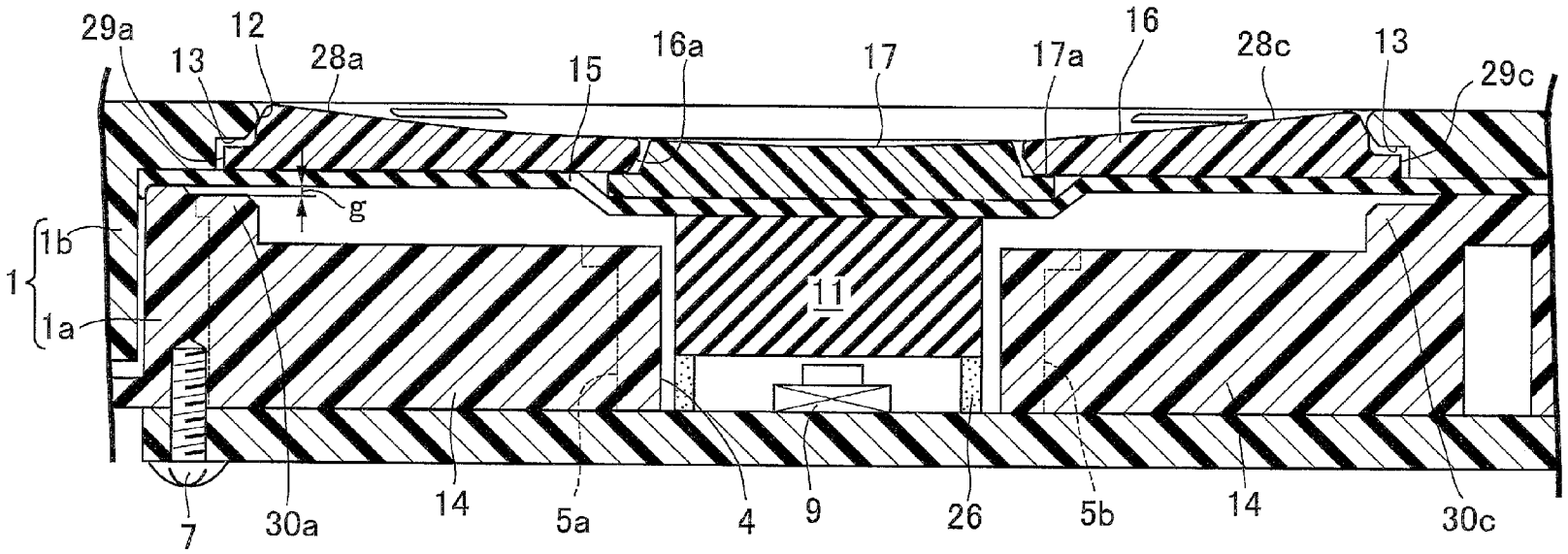
FIG. 5 is a sectional view taken along a line 5-5 in FIG. 1.

As illustrated in FIGS. 1 and 5, the outer switch knob 16 includes: first to fourth switch dead parts 28*a* to 28*d* arranged with a phase shift by 45° from the first to fourth switch operation parts 18*a* to 18*d*, respectively; and first to fourth movable stoppers 29*a* to 29*d* arranged in phase with the first to fourth switch dead parts 28*a* to 28*d* and integrally formed to project from the outer peripheral surface of the outer switch knob 16. Then, first to fourth fixed stoppers 30*a* to 30*d* opposed to the first to fourth movable stoppers 29*a* to 29*d*, respectively, via the water-proof diaphragm 15 are integrally formed on the lower case 1*a*. A certain gap g is provided between each of the first to fourth fixed stoppers 30*a* to 30*d* and a lower surface of the water-proof diaphragm 15.

Here, a stroke in which, in response to a push of any one of the first to fourth switch operation parts 18*a* to 18*d*, one of the transmission members 10*a* to 10*d* corresponding to the pushed switch operation part turns on the corresponding one of the switches 8*a* to 8*d* is larger than a stroke in which, in response to a push of any one of the first to fourth switch dead parts 28*a* to 28*d*, one of the first to fourth movable stoppers 29*a* to 29*d* corresponding to the pushed switch dead part comes into contact with the corresponding one of the fixed stoppers 30*a* to 30*d*.

Next, an operation of the present embodiment is described.

Here, if a user pushes any one of the first to fourth switch operation parts 18*a* to 18*d*, for example, the first switch operation part 18*a*, the outer switch knob 16 swings downward by using, as a swing pivot, an upper edge portion of the top surface 21 of the third pivot projection 20*c* on the opposite side from the pushed first switch operation part 18*a* with the top surface 21 being supported by the downward-facing stepped portion 13, and presses the pressure receiving projection 24 of the first transmission member 10*a* while curving the water-proof diaphragm 15. Thus, the first transmission member 10*a* moves downward while bending the elastic leg 25, and pushes the actuator of the first switch 8*a* to turn on the first switch 8*a*.

Figure 6:
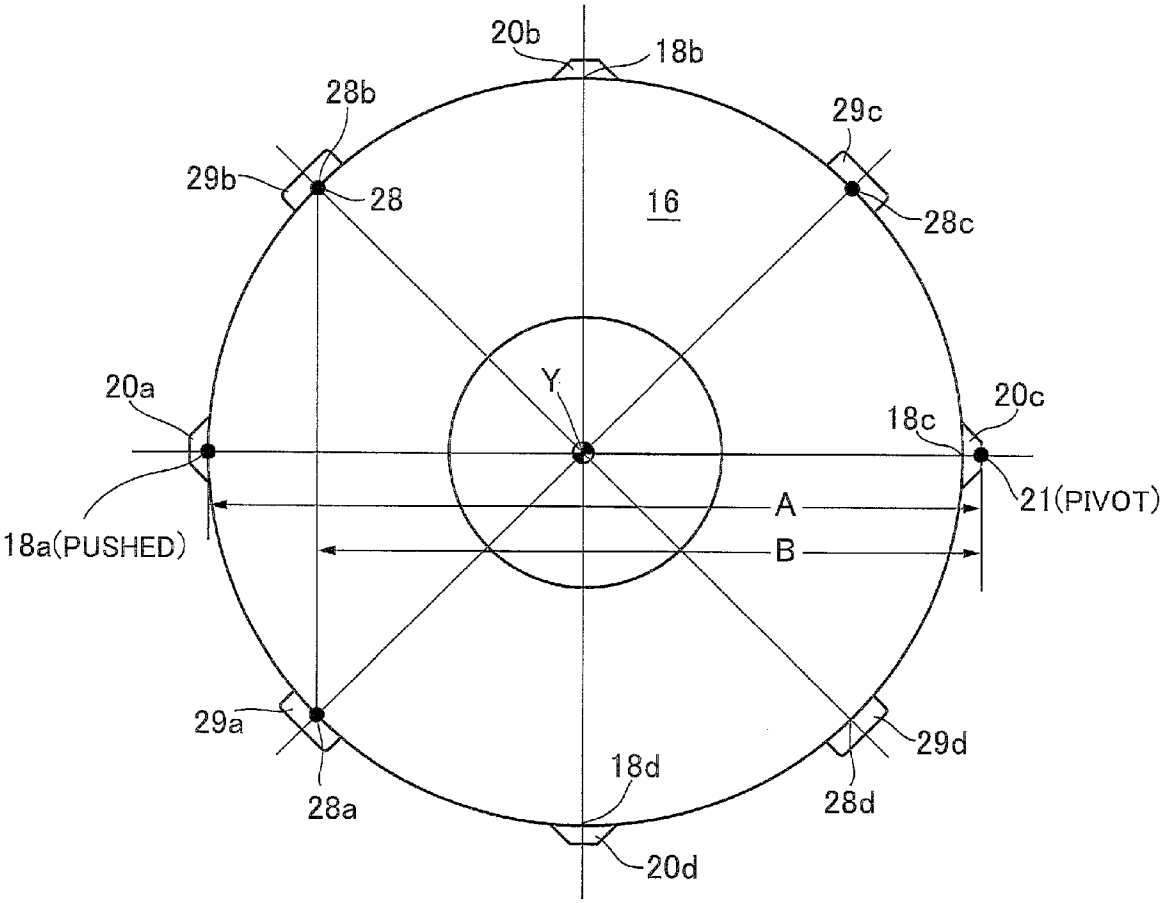
FIG. 6 is an operation explanatory plan view at a time when a first switch operation part of the switch knob is pushed.

At this time, as illustrated in FIG. 6, a distance A from the swing pivot to the first switch operation part 18*a* is longer than a distance B from the swing pivot to each of the first and second switch dead parts 28*a*, 28*b* adjacent to the first switch operation part 18*a*, and accordingly downward strokes of the first and second switch dead parts 28*a*, 28*b* are smaller than a downward stroke of the first switch operation part 18*a*. In addition, since the certain gaps g are reserved between the lower surface of the water-proof diaphragm 15 and the first and second fixed stoppers 30*a*, 30*b* corresponding to the first and second switch dead parts 28*a*, 28*b*, respectively, the first and second movable stoppers 29*a*, 29*b* come close to, but do not come into contact with the first and second fixed stoppers 30*a*, 30*b* via the water-proof diaphragm 15 while the first switch 8*a* is in an on state.

Moreover, when the first switch operation part 18*a* is pushed, since the upper edge portion of the top surface 21 of the third pivot projection 20*c* serving as the swing pivot of the outer switch knob 16 forms a straight line orthogonal to a radius line of the outer switch knob 16, the swing pivot is formed as a pivot axis, which can prevent the outer switch knob 16 from tottering and can also improve durability of the pivot projections 20*a* to 20*d*.

In addition, even if the outer switch knob 16 totters, any one of the first and second movable stoppers 29*a*, 29*b* adjacent to the first switch operation part 18*a* comes into contact with the corresponding one of the first and second fixed stoppers 30*a*, 30*b* via the water-proof diaphragm 15, which can prevent the outer switch knob 16 from tottering excessively and avoid an unnecessary actuation of any switch other than the first switch 8*a*.

When push operation on the first switch operation part 18*a* is cancelled, the outer switch knob 16 is restored to its original position by use of repulsive force of the elastic leg 25 of the first transmission member 10*a*, and the first switch 8*a* is automatically returned to an off state.

The same operation as that described above can be performed when any of the second to fourth switch operation parts 18*b* to 18*d* is pushed. Instead, when the center switch knob 17 is pushed, the center transmission member 11 is pushed down via the water-proof diaphragm 15, thereby enabling the center switch 9 to be turned on.

Figure 7:
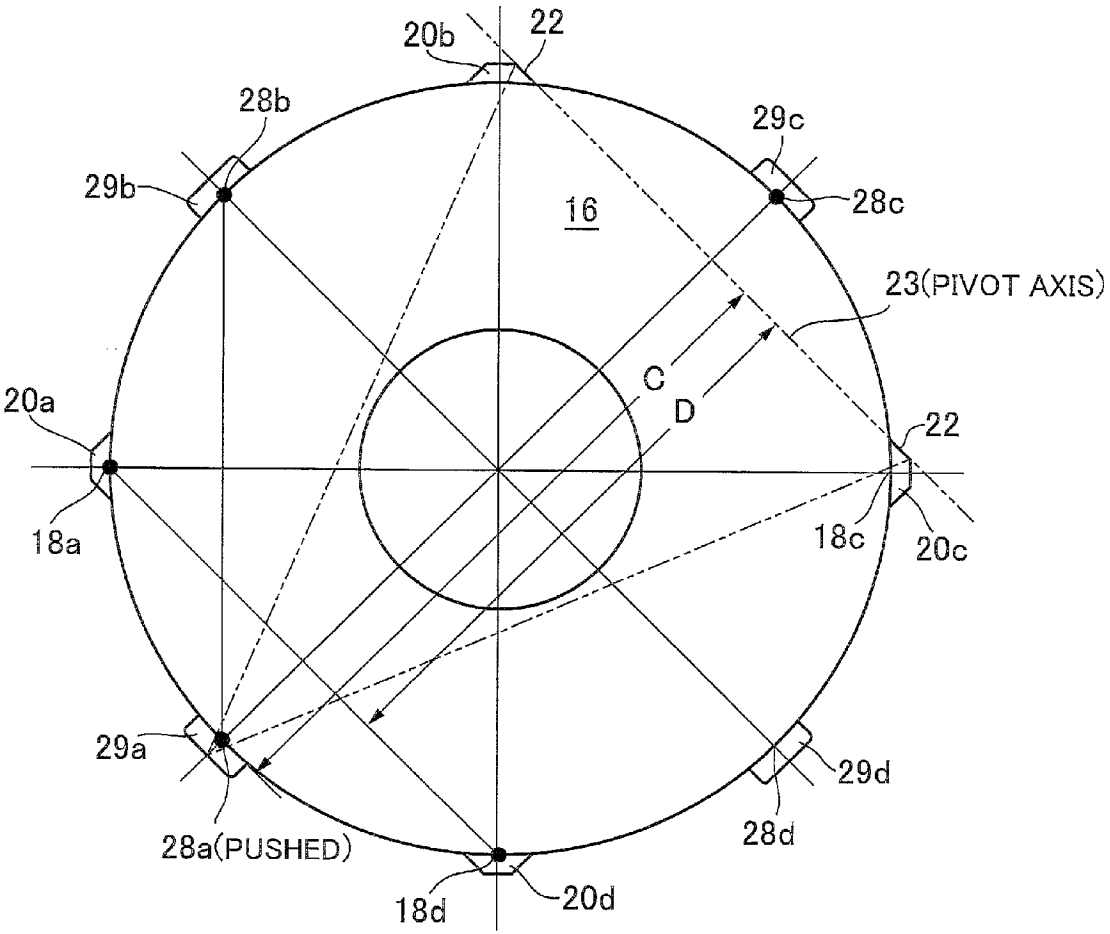
FIG. 7 is an operation explanatory plan view at a time when a first switch dead part of the switch knob is pushed.

In addition, when the user pushes by mistake the first switch dead part 28*a*, for example as illustrated in FIG. 7, the outer switch knob 16 slightly swings while curving the water-proof diaphragm 15 by using as a pivot axis the straight line 23 connecting the second and third pivot projections 20*b*, 20*c* on the opposite side of the first switch dead part 28*a* with the center axis Y in between, but immediately after that, is stopped from swinging when the first movable stopper 29*a* on the outer switch knob 16 comes into contact with the first fixed stopper 30*a* via the water-proof diaphragm 15.

At this time, a distance C from the above pivot axis to the first switch dead part 28*a* is longer than a distance D from the above pivot axis to each of the first and fourth switch operation parts 18*a*, 18*d* adjacent to the first switch dead part 28*a*, and accordingly downward strokes of the first and fourth switch operation parts 18*a*, 18*d* are smaller than a downward stroke of the first switch dead part 28*a*. Further, since actuation strokes of the switches 8*a* to 8*d* are set to be larger than downward strokes of the switch dead parts 28*a* to 28*d*, the first and fourth switches 8*a*, 8*d* corresponding to the first and fourth switch operation parts 18*a*, 18*d*, respectively, can be kept off. In other words, this prevents erroneous actuations of the first and fourth switches 8*a*, 8*d*.

Moreover, at this time, the outer switch knob 16 is supported by three points of the second and third pivot projections 20*b*, 20*c* and the first movable stopper 29*a*, which prevents the outer switch knob 16 from tottering, and also prevents the erroneous actuations of the first and fourth switches 8*a*, 8*d* due to the tottering motion.

Furthermore, since the adjacent inclined surfaces 22 of the adjacent second and third pivot projections 20*b*, 20*c* are positioned on the common straight line 23, the respective pivots of the second and third pivot projections 20*b*, 20*c* supported by the downward-facing stepped portion 13 are in line contact with the downward-facing stepped portion 13, in the swing of the outer switch knob 16. Thus, the durability of the second and third pivot projections 20*b*, 20*c* can be enhanced.

The same operation as that described above can be performed when any of the second to fourth switch dead parts 28*b* to 28*d* is pushed.

The present invention should not be limited to the foregoing embodiment, but can be modified in design in various ways without departing from the gist of the invention. For example, the upward biasing forces on the transmission members 11, 10*a* to 10*d* may be applied by using automatic returning forces of the actuators of the switches 8*a* to 8*d*, 9, instead of the elastic legs 25, 26. Moreover, the center switch knob 17 and the center switch 9 may be omitted.

What is claimed is:

1. A four-direction switch device comprising:

a switch case having an opening portion in an upper wall thereof;

a plate-shaped switch knob arranged in the opening portion, the switch knob being set to have first to fourth switch operation parts arranged at angular intervals of 90° about a center axis of the switch knob; and first to fourth switches provided in the switch case and to be actuated respectively in response to push operations on the first to fourth switch operation parts, wherein the switch knob is formed in a disc shape, and is provided with first to fourth pivot projections and first to fourth movable stoppers on an outer peripheral surface of the switch knob, the first to fourth pivot projections projecting radially outward and arranged in phase with the first to fourth switch operation parts, the first to fourth movable stoppers arranged with a phase shift by 45° from the first to fourth pivot projections, respectively, the switch case is provided with a downward-facing stepped portion for supporting the first to fourth pivot projections from an upper face side of the first to fourth pivot projections, and first to fourth fixed stoppers opposed to lower surfaces of the first to fourth movable stoppers, respectively, when the switch knob is pushed at one of the first to fourth switch operation parts, the switch knob swings so that one of the first to fourth pivot projections, located on a side of the switch knob opposite to the one of the first to fourth switch operation parts being pushed with the center axis of the switch knob interposed therebetween, is placed in contact with the downward-facing stepped portion, to turn on one of the first to fourth switches associated with the one of the first to fourth switch operation parts being pushed, and when the switch knob is pushed at a switch dead part located in an intermediate position between adjacent switch operation parts of the first to fourth switch operation parts, the switch knob swings about a straight line connecting a pair of pivot projections of the first to fourth pivot projections located on a side of the switch knob opposite to the switch dead part being pushed with the center axis of the switch knob interposed between the pair of the pivot projections and the switch dead part being pushed, with the pair of the pivot projections being placed in contact with the downward-facing stepped portion, and one of the first to fourth movable stoppers located below the switch dead part being pushed brought into contact with one of said first to fourth fixed stoppers located below the switch dead part being pushed, so as to stop the switch knob from swinging further, thereby avoiding actuations of the switches.

2. The four-direction switch device according to claim 1, wherein each of the pivot projections includes a flat top surface orthogonal to a diameter line of the switch knob and a pair of inclined surfaces inclined to descend from opposite ends of the top surface to the outer peripheral surface of the switch knob, and the adjacent inclined surfaces of each pair of the adjacent pivot projections are positioned on a common straight line.

* * * * *